US005603773A

United States Patent [19]

Campbell

[11] Patent Number: 5,603,773

[45] Date of Patent: Feb. 18, 1997

[54] METHOD OF CLEANING CHANDELIERS

[76] Inventor: Keith S. Campbell, 13432 Third Ave. N.E., Bradenton, Fla. 34202

[21] Appl. No.: 520,093

[22] Filed: Aug. 28, 1995

Related U.S. Application Data

[62] Division of Ser. No. 153,294, Nov. 16, 1993, Pat. No. 5,472,005.

[51] Int. Cl.[6] ..... B08B 3/12

[52] U.S. Cl. ..... 134/1; 134/25.4; 134/25.5

[58] Field of Search ..... 134/1, 25.1, 25.4, 134/25.5

[56] References Cited

U.S. PATENT DOCUMENTS 3,392,964 7/1968 Krolik et al. ..... 134/188 X 4,367,098 1/1983 McCord ..... 134/25.4 X 4,483,718 11/1984 Bross et al. ..... 134/25.4 X 5,021,097 6/1991 Konig et al. ..... 134/25.5

*Primary Examiner*—Jeffrey Snay

*Attorney, Agent, or Firm*—Herbert L. Gatewood

[57] ABSTRACT

Apparatus for cleaning a chandelier in situ by ultrasonic cavitation. The chandelier is made up of a plurality of spaced-apart elongated pendants each extending vertically downwardly and being arranged in a plurality of parallel rows and columns of pendants in a rectangular pattern.

13 Claims, 5 Drawing Sheets

METHOD OF CLEANING CHANDELIERS

This application is a of application Ser. No. 08/153,294 filed Nov. 16, 1993, now U.S. Pat. No. 5,472,005.

BACKGROUND OF THE INVENTION (1). Field of the Invention

This invention relates, in general, to a method of and apparatus for the ultrasonic cleaning in situ of a plurality of objects located in a linear row in predetermined spaced-apart locations. More particularly, the invention is directed to the ultrasonic cleaning of chandeliers comprising a plurality of rows of downwardly extending elongated crystal pendants.

(2).Description of the Prior Art

The term ultrasonics(or supersonics) refers to sound vibrations, i.e., variations of density in elastic media such as air and water, whose frequencies are beyond the auditory limit. The frequencies of ultrasonic vibration are above approximately 20,000 cycles/sec. Nevertheless, higher ultrasonic frequencies may be in the order of 10 million cycles/sec. Such high-frequency vibrations are produced in various ways, based upon different principles.

Ultrasonic vibrations are used in many technical applications. One such use involves the cleaning of a wide variety of objects, e.g., jewelry, castings, automobile radiators, biofouled heat exchangers, etc. The ultrasonic cleaning of objects depends upon cavitation, i.e., the rapid formation and violent collapse of minute bubbles or cavities in a cleaning solution or liquid. This action creates a highly effective and unique penetrating action that, in a sense, blasts dirt, grit, and other contaminants from the surface of an object that has been covered with such materials. Ultrasonic cleaning can get into crevices in an object where dirt, etc. lies that other cleaning methods can not readily accomplish, if at all. It can remove contaminants that defy soaking, scrubbing, spraying and other conventional cleaning methods.

Over the last several years, it has become somewhat customary to provide chandeliers in restaurants, motels, bars and other public places which comprise a plurality of downwardly extending, spaced-apart, elongated crystals or pendants. The pendants are, in general, provided in a rectangular-shaped pattern of a plurality of rows of pendants, the rows being provided parallel to one another.

A chandelier may comprise, in at least some cases, a number of tiers of pendants, e.g., an inner or centrally located tier, a middle tier that surrounds the inner tier, and an outer tier of parallel rows and columns of pendants in surrounding association with both the inner and middle tier. The middle and inner tiers also comprise a plurality of parallel rows and columns of pendants. The bottom ends of the pendants in the multiple rows and columns of pendants terminate in different horizontal planes parallel to one another. The pendants are of different lengths, e.g., the outer row of pendants in the outer tier are the longest, while those located in the inner rows of the outer tier are of a shorter length. The top ends of the pendants located in the inner rows are located such that the top ends of such pendants lie in a horizontal plane located above that in which the bottom ends of the pendants in the outer row terminate. Thus, the top ends of those pendants located in the inner rows are hidden from view, allowing the shorter length pendants to be used in the construction of the chandelier, rather than pendants all of the same length. In a similar manner, the tops of the pendants making up those tiers located more inwardly can lie in a horizontal plane above that in which the bottom of the pendants in the next adjacent outer tier lie.

The elongated pendants making up such a chandelier as above-described are, in general, suspended vertically downwardly from the ceiling of a room or other area in which the chandelier is located. The ceiling or other horizontal surface from which the pendants are suspended by their top ends is generally provided with a horizontally disposed planar mirror, i.e., a reflective surface, which may be of glass or metal. Located somewhat below the reflective surface are a plurality of spaced-apart light fixtures in which are located light bulbs of suitable size.

The pendants are of conventional lead containing glass. Thus,the pendants, particularly when provided with multiple surfaces along the length thereof, are reflective to light. The pendants, in general, are of triangular cross-section with inwardly curved surfaces; however, the pendants are sometimes of other configuration, even of cut glass. Thus, the pendants reflect light from the light bulbs and that reflected from the mirror, providing an attractive chandelier, and enhancement of the appearance of the surroundings.

The pendants making up such a chandelier not only vary in length as earlier disclosed but also may vary in length from one chandelier to another, depending upon the particular needs for such a chandelier. Thus, the pendants in the outer row of the outer tier of pendants may be as much as from about 18 inches to about 3 feet in length, with those located in the inner rows varying from about 4–5 inches to about 8–10 inches or so. The pendants may be provided in as many as 8 to 10 rows of pendants in a tier. The length of such a chandelier may vary from a few feet, e.g., 8 or 10 feet up to as much as 30 feet, depending somewhat on where such a chandelier is located. The width of a 30' chandelier may be as much as 15 feet, e.g. a chandelier having a length of 30 feet may be as wide as 15 feet. A chandelier of this size may comprise several thousands, e.g. ten thousand elongated pendants, each being individually suspended by their top ends from the ceiling of a room. Chandeliers about 8 feet long and about 4 feet wide are more common. Nevertheless, such a chandelier may be made up of several thousands of pendants.

The pendants in the outer row of pendants in a chandelier, e.g., the outer row of the outer tier are, in general, attached to the ceiling by conventional "S" hooks, so that the top of each pendant in the outer row is located about ½ inch or so down from the ceiling. The pendants located in the inner rows of pendants are suspended from the ceiling, in general, by a conventional flexible chain comprising metal beads, the chain being attached at its top end to the ceiling and at the bottom end to the top end of a pendant. Thus, a conventional eye fastener is provided in the top end of a pendant, the "S" hook being connected to that eye fastener and to another eye fastener provided in the ceiling.

In some cases, the top ends of the pendants are not connected to the ceiling. Instead, a horizontally disposed planar member will be provided which is connected to the ceiling so as to be parallel thereto. The tops of the pendants are connected to that horizontally disposed member. At other times, a stepped platform or one arranged in tiers will be provided, that platform being directly attached to the ceiling of a room and providing a plurality of horizontally disposed planar members to which the tops of the pendants are attached. Thus, when "ceiling" is used herein, it will be appreciated that the top of the pendants are attached to a horizontally disposed surface and extend vertically downwardly therefrom but that such a member is not necessarily the ceiling.

As can be readily expected, the surfaces of the glass pendants over time become covered with dust and other contaminants from the environment. Thus, the reflectiveness of the chandelier pendants is continually reduced. And, the attractiveness of the chandelier is greatly diminished. It becomes necessary eventually that the pendants be cleaned, to restore the sparkling appearance to the pendants and to regain the initial sparkle and reflectiveness thereof, and to restore the overall attractiveness of the chandelier.

The cleaning of such chandeliers heretofore has involved a variety of methods. One such method known of for cleaning the pendants has involved the spraying of the pendants in place with an acid containing water solution. Although this manner of cleaning has been found satisfactory to a certain degree, it has also been found a ruinous practice over time not only to the glass pendants but also to the mirror and light fixtures, as well as any metal element. Thus, from time-to-time, or eventually, these elements making up the chandelier need to be replaced.

Another method for the cleaning of such chandeliers has required a number of laborious and time-consuming operations. First, the pendants must each be taken down from the ceiling so that they can be cleaned. The numerous pendants e.g., in some cases 6–10 thousand, are all then immersed in a cleaning solution provided in an appropriate tank or container therefor and allowed to remain therein for a suitable time to remove the contaminants. Afterwards, the pendants maybe subjected to a rinse bath. Following cleaning and rinsing, the pendants are allowed to dry off some and then are individually reattached to the ceiling in the appropriate locations to reconstruct the chandelier, i.e., rehanging each of the pendants on a conventional "S" hook or the like so as to extend vertically downwardly from the ceiling.

The taking down and rehanging of the pendants has presented certain problems. One problem involves the "S" hook fastening members. When a chandelier is first constructed, those constructing the chandeliers see to it that the ends of the "S" fastener are closed. This better ensures that the pendants will not be accidently disconnected from the ceiling. Such a happening could result in serious injury to a person that might be hit by a falling pendant, sometimes 30" or so in length.

As a result of the "S" fastener being closed at its ends, it is necessary for one taking a pendant down to be cleaned to bend an end of the "S" fastener to open it, in order that the pendant can be taken down. With the closeness of the spacing of the pendants from one another this can be achieved only with some difficulty. More importantly, however, when the pendants are again rehung, the "S" fastener end is ordinarily not closed but, instead is left open. The closing of the "S" is time consuming and difficult to accomplish. The result of this practice is believed to present a potentially hazardous condition. This is particularly the case, it is believed, where a chandelier may be installed adjacent an outer door, e.g. a motel lobby, and be subject to occasional gusts of air or wind. The same is true where the pendants may be subject to some vibration, though slight, for example, where a chandelier might be located adjacent a bank of elevators. The extent of the potential for the dis-lodgement of a pendant from its "S" fastener depends largely upon how much the end of the "S" was opened to be able to take down a particular pendant. This, as will be readily appreciated, depends upon who took the pendant down. One person may be inclined to open the "S" fastener more than another.

Heretofore, the chandelier pendants have also been cleaned by ultrasonic means. This procedure has involved, in general, the taking down of the pendants individually as earlier disclosed and immersing them in a cleaning solution contained in a tank or container provided for the purpose and in which an ultrasonic means has been provided. The cleaned pendants are then rinsed, allowed to dry, and then rehung from the ceiling as earlier described.

The cleaning of the chandelier pendants in this manner last disclosed i.e., by ultrasonic means, has been accomplished without any particular concern as to the shape and size of the tank or vessel containing the cleaning liquid. In general, any tank available to the cleaning business has been used. A tank to be selected was generally of a desirably large size so as to be able to hold at one time a relatively large number of the pendants taken down from a particular chandelier. Thus, a tank used heretofore for such a cleaning operation was 80 inches long and contained 70 gallons or so of cleaning liquid. Transducers for such a cleaning tank were basically selected by a rule-of-thumb provided by the manufacturer, e.g., a transducer element for each gallon of water. As a result a 70 gallon tank would be provided with at least four immersible transducers each comprising 12 transducer elements. The pendants, on being taken down from the chandelier, are placed in an open basket, one on top of the other the basket then being placed in the cleaning tank. Or, in some cases, the pendants may be merely placed directly in the cleaning tank. No matter which procedure is involved, however, the pendants are closely bunched together and in contact with one another, one on top of the other. After cleaning the pendants are removed from the tank or basket one at a time to be rehung for the reconstruction of the chandelier.

Although this last disclosed method of cleaning, i.e., by ultrasonics, is far more satisfactory than cleaning by the spray method disclosed earlier, the use of such apparatus and method of cleaning is still attendant with certain faults. While the pend, ants after this cleaning procedure are seen to be much cleaner and light reflective than prior to the ultrasonic cleaning thereof, at least some of the pendants on closer inspection appear not to have been uniformly cleaned. Although I do not wish to be held to this theory, this apparently results from the manner in which the pendants are placed in the basket or cleaning tank. The pendants are laid flat, one upon the top of another. Thus, it would appear that as the ultrasonic waves are propagated toward the elongated pendants to be cleaned that the surfaces thereof may not be uniformly contacted. As a result, shadowing occurs wherein some of the surfaces of the pendants are precluded from receiving the ultrasonic waves, or at least to the same extent. The pendants, as will be appreciated, each contact a part of the surface of a next adjacent pendant. Other parts of the surface of a pendant is available to be contacted by the cleaning liquid. Moreover, those surfaces of a pendant facing downwardly toward the bottom of the cleaning tank are more directly opposed to the transducers than are the top surfaces of the pendants, allowing for possible non-uniform cleaning.

of somewhat lesser concern than nonuniform cleaning of a pendant is the problem of handling the pendants. The pendants need be detached from the "S" hooks, placed in the basket or tank, and then rehung. Though care is taken in the handling there is, necessarily, some breakage. When such occurs, the broken pendant or pendants need be replaced. Thus, for a time, the chandelier may be clean but it is less attractive because of the missing pendants.

Nevertheless, whether the cleaning of the chandeliers heretofore has been accomplished by ultrasonic or other means, it will be readily appreciated that any such a procedure has been a somewhat time consuming task and quite labor intensive. And because of this, the cleaning of the chandeliers as disclosed heretofore has been somewhat expensive. To clean a chandelier of a size as earlier disclosed, e.g., one 4'×8', prior to my invention, has taken 1 ½ days with two people. The larger part of that time, however, is spent in the labor of taking down the individual pendants and then rehanging them again, after such have been cleaned. Once taken down, the ultrasonic cleaning of the pendants takes only a few minutes, depending largely on how soiled the pendants are. This depends to some extent upon just where the chandelier is located. For example, the pendants of such a chandelier located in a lobby adjacent a door to the outside or opposite an air vent may become substantially more dirty and less reflective, and in a shorter period of time, than the same configuration of chandelier located in a ballroom. Thus, the cleaning heretofore of chandeliers comprising downwardly extending pendants has involved considerable expense and effort due, primarily, to its labor intensiveness, as earlier more fully described. This effort and expense is determined to a large extent upon the size and configuration of the chandelier, i.e., the number of columns and rows of pendants, the length of the columns and rows, and the spacing of the pendants from one another.

Due to the above, institutions whereat such chandeliers are installed often have the chandeliers cleaned less often than is really needed or actually desirable. This is particularly the case where a number of the chandeliers are installed at a particular institution. Moreover, in some cases, chandeliers comprising downwardly extending pendants have not been cleaned, since their installation. With some such chandeliers the pendants are so closely spaced together, e.g., only about 1 inch apart, that it is not possible to take the pendants down for cleaning. The only cleaning method possible for such a chandelier is by spray cleaning which is-not only undesirable, for the reasons earlier disclosed, but also not effective for good cleaning. Moreover, wiping the pendants clean in place can not be really accomplished due to the close spacing of the pendants in these chandeliers. The size of the pendants, generally about 8 inches long, and the fact that such a chandelier may comprise several hundreds, even thousands in some cases, of pendants makes the cleaning of the chandelier impractical, if not impossible.

Thus, there is a real need for a better method of cleaning the chandeliers such as disclosed herein and apparatus for accomplishing such in a manner that is less labor intensive, resulting in not only considerably less time and effort for the cleaning but also attendant costs.

SUMMARY OF THE INVENTION

Therefore, a primary object of the invention is to provide a method and means for the cleaning of chandeliers comprising a plurality of parallel columns and rows of downwardly extending spaced-apart pendants not having the problems above-mentioned.

It is another object of the invention to provide a method of and apparatus for the ultrasonic cleaning of such chandeliers as disclosed herein in situ.

Another object of the invention is to provide apparatus and a method of cleaning chandeliers in situ comprising downwardly extending pendants that is not only environmentally safe but also conserves water compared to present apparatus used and method of cleaning such chandeliers.

Still an object of the invention is provide apparatus for the cleaning in situ of chandeliers comprising a plurality of downwardly extending pendants wherein a plurality of pendants are cleaned simultaneously.

A further object of the invention is to provide ultrasonic cleaning apparatus for the cleaning in situ of downwardly extending elongated pendants or the like that is relatively simple in design and construction.

A still further object of the invention is to provide apparatus for the ultrasonic cleaning of a plurality of downwardly extending pendants or the like in situ, and simultaneously, that is relatively inexpensive to manufacture, rugged in construction, easy to use, and efficient in operation.

An even further object of the invention is to provide apparatus and a method for the cleaning of chandeliers comprising a plurality of downwardly extending pendants in situ whereby the costs of such a cleaning is somewhat less expensive in overall costs than such a cleaning operation now involves.

An even still further object of the invention is to provide apparatus for and method of ultrasonic cleaning of chandeliers comprising downwardly extending pendants from the ceiling of a room that is more efficient and less labor intensive, allowing such chandeliers to be cleaned more often than now done, to maintain them in the most attractive condition and appearance.

These objects, as well as further objects and advantages of the present invention, will become more readily apparent, it is believed, after reading the ensuing description of a non-limiting illustrative more preferred embodiment of the invention while referring to the accompanying drawings.

BRIEF DESCRIPTION OF THE DRAWINGS

In order that the present invention may be more fully understood it will now be described, by way of example, with reference to the accompanying drawings, in which.

DETAILED DESCRIPTION OF THE INVENTION AND THE PREFERRED EMBODIMENTS THEREOF

Although the present invention will be described hereinafter with particular reference to the accompanying drawings, it is to be understood at the outset that it is contemplated that the invention may be varied in specific detail from that illustrated and described herein while still achieving the desirable characteristics and features of the invention. Accordingly, the description which follows is intended to be understood as a broad enabling disclosure directed to persons skilled in the applicable arts, and is not to be understood as being restrictive.

Figure 1:
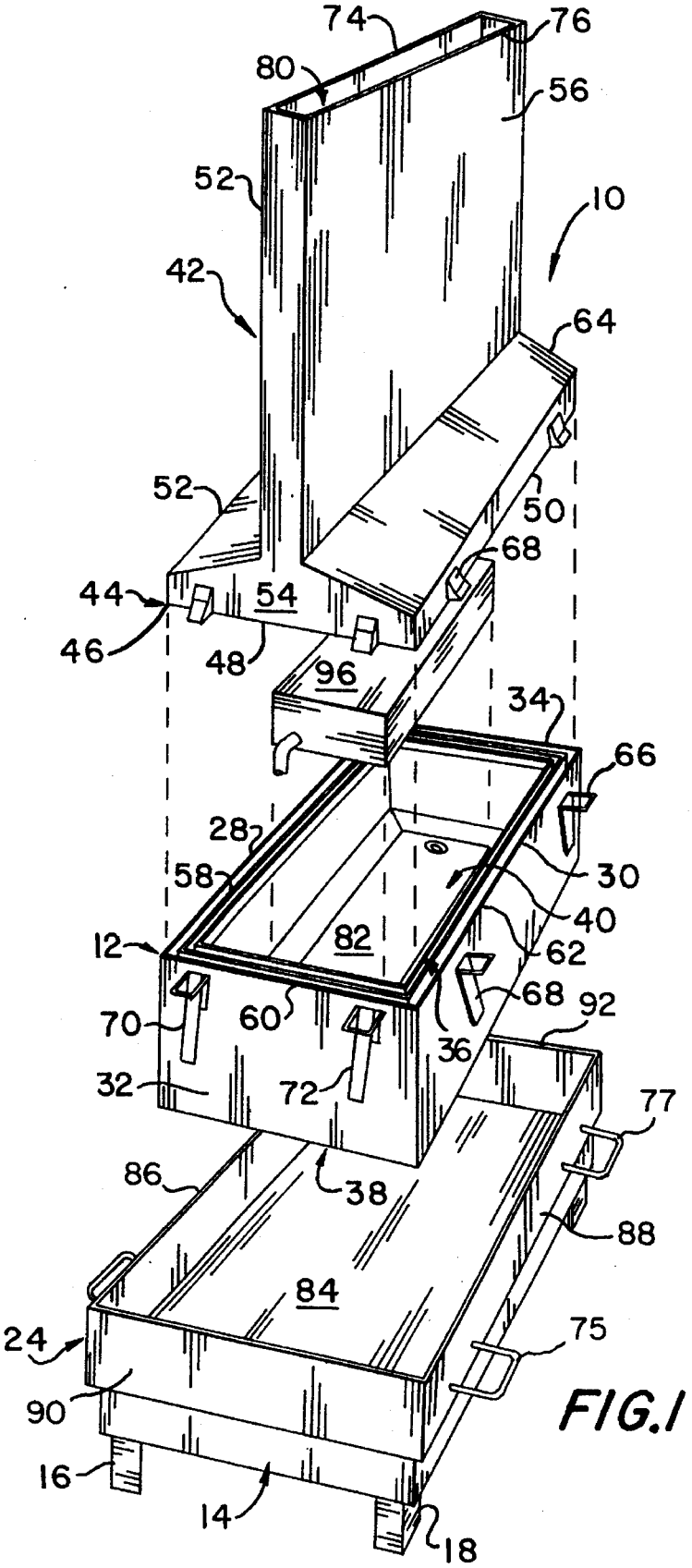
FIG. 1 is an exploded view in perspective showing ultrasonic cleaning apparatus according to the invention.

Turning now to FIG. 1 of the drawings, there is illustrated therein an ultrasonic cleaning apparatus 10, incorporating the principals of the present invention. The cleaning apparatus 10 comprises an elongated base or bottom member 12 supported by a platform 14 having downwardly extending legs 16,18,20, and 22, the latter leg being shown only in FIG. 4 of the drawings.

As shown in the drawings, a Jacket 24 surrounds the base member 12 at its bottom end and is spaced apart therefrom equidistantly on all sides providing an overflow channel 26, the purpose for which will later be fully disclosed.

The base member 12 comprises vertically upright, spaced-apart side walls 28,30 in parallel disposition to one another and vertically upright, spaced-apart, parallel end walls 32,34 intersecting therewith and in perpendicular disposition to the side walls. Thus, there is provided a bottom or base member 12 of rectangular shape having an open top end 36, and a bottom end 38 defining an internal cavity 40.

Detachably connected to the base member 12 at its top end 36 there is provided a top member or cap 42 of a predetermined configuration, as shown in FIG. 1. The bottom end 44 of the top member 42 is of the same rectangular configuration as that of the base member 12. The bottom edges 46, 48, and 50 of the side and end walls 52, 54, and 56, respectively, of the top member are located in flat-bottomed U-shaped members 58, 60, and 62 fixedly secured in conventional manner at the top edges of the base member. The bottom edge Opposite from bottom edge 48 of the top member is not shown in the drawing; however, it will be appreciated that such is at the bottom of end wall 64. The U-shaped member can have a Curved bottom; however, this is somewhat less desired, due to the flat shape of the bottom edges of the top member.

The U-shaped members can be provided on the top edges of the bottom member 12, and such is preferred; however, such can, instead, be provided on the inner surfaces of the side and end walls. Thus, a U-shaped member or flange will be provided for intrusion of the respective bottom edges of the top member. In this case, the bottom end of the top member will be of slightly lesser dimensions to allow for the bottom edges to fit into the U-shaped channel provided. The important consideration here is that, when the top and bottom members are secured together, a liquid tight seal is provided between the top and bottom members at their respective top and bottom ends. Such can readily be constructed, it is believed, by those skilled in the art. Nevertheless, the U-shaped channel provided on the top edges of the base member will allow somewhat easier construction of the locking members. Most importantly, however, it provides better structural support of the top member.

Located on the side and end walls 30, 56 and 32, 54 respectively, of the bottom and top members are conventional clamping or fastening means designated generally by reference numerals 66, 68 and 70, 72. Like fastening means, not shown in the drawings, will be provided on the opposing side and end walls of the top and bottom members. Various fastening means may be found suitable for the intended purpose; however, I have found that the two part fastening means such as commonly provided on foot lockers and trunks are quite satisfactory. These fastening means allow the top and bottom members to be drawn into tight sealing engagement with one another. As earlier disclosed, however, various of conventional fastening means may be found suitable for the intended purposes. The main thing is that a fastening means be provided on each of the top and bottom members at their respective bottom and top ends and in direct opposition to one another so that when the bottom edges of the top member fit into the U-shaped member or flange of the bottom member in operative engagement, and the fastening means is operated to connect the two members together, the top and bottom members will be brought into a tight, sealing engagement with one another. A suitable gasket member will need be provided in the U-shaped member or flange, according to usual techniques.

The fastening means are provided on the bottom and top members in predetermined spaced-apart locations, as shown in the drawings, so as to provide for good sealing engagement along the entire lengths of the mating edges. Although, only two fastening means are shown to be provided on each of the side and end walls, it will be appreciated that a larger number or different spacing between next adjacent fastening means can be provided, if desired or needed, to provide the optimum sealing engagement. This will depend to some extent upon the length and width of the ultrasonic cleaning apparatus, i.e., the base member 12.

As shown in FIG. 1, the side walls 52, 56 of the top member are spaced-apart from one another at their bottom ends and in parallel relationship for a distance vertically upwardly. Then, the side walls incline inwardly toward one another at equal angles and for the same distance. The side walls 52, 56 then again become parallel and rise vertically upwardly terminating in the spaced-apart top edges 74, 76. The width of the top member 42, i.e., the distance horizontally and perpendicularly, between the parallel side walls at the top edges can vary somewhat, as will be later more fully appreciated. In general, this will depend upon the width of the pendants that are desired to be cleaned and the number of rows or columns of pendants to be cleaned at one time, as well as the spacing between the rows and columns of pendants. The length of the pendants, i.e., the distance from the top to the bottom end of a pendant in any particular row or column will also influence the particular configuration and dimensions of the top member.

The pendant length will also, importantly, influence the most optimum depth of the top member, i.e., the length from the top end thereof to the bottom end of the top member. This will depend largely upon the length of the pendants to be cleaned in any particular application or chandelier. Thus, the top member, when taken with the depth of the base member in consideration, will need be deep enough to accommodate the length of the longest pendants in a particular chandelier to be cleaned. Thus, if the length of the top member, i.e., the distance from the top end to the bottom end, is designed for the longest pendant anticipated to be cleaned, it will be found suitable for the cleaning of any pendants of a shorter length.

In the chandeliers of the type disclosed herein, it is common practice to have those pendants located in the outermost row of pendants of the longest length. Also, it is common to provide a chandelier having multiple tiers, e.g. an inner, a middle, and an outer tier. Each tier comprises a multiplicity of rows and columns in parallel disposition to one another, each row and column comprising a predetermined plurality of spaced-apart pendants and being arranged linearly in a rectangular-shaped pattern. The pendants in the more inner rows, i.e., not the outermost row, are generally much shorter in length than those in the outer row, i.e., the outer row in the outer tier. Thus, the pendants in the outer-most row, e.g., those located in the outer row in the outer tier of pendants, may be from about 18 inches to as much as about 3 feet or so in length. Nevertheless, the pendants located in the inner rows may only be, in the same chandelier, from about 2–10, usually about 6 inches in length.

Accordingly, if the top member of the cleaning apparatus is designed with only the longest length pendant of a chandelier in mind it will be "overdesigned"for most of the pendants in a chandelier to be cleaned. This is of somewhat critical concern as the cleaning apparatus of this invention is to provide cleaning of the hanging pendants of a chandelier in situ. The problem with such an apparatus, i.e., one not taking into account the entire chandelier, is primarily in the unnecessary size and in the handling of the apparatus. This naturally presents some difficulty, as will be better appreciated hereinafter. Also, too large a cleaning apparatus for the particular chandelier to be cleaned necessitates the use of more cleaning liquid than is really necessary for the Job at hand. This not only adds to the cost of cleaning of a chandelier and the overall costs to the operation of the business, but more importantly perhaps to the waste of water, as well. In some areas of the United States, the consumption and conservation of water resources is becoming an ever increasing problem. Further, although, a top member such as shown in FIG. 1 can be used in the cleaning of an entire chandelier, the use of such is not only impractical but also inefficient.

Figure 2:
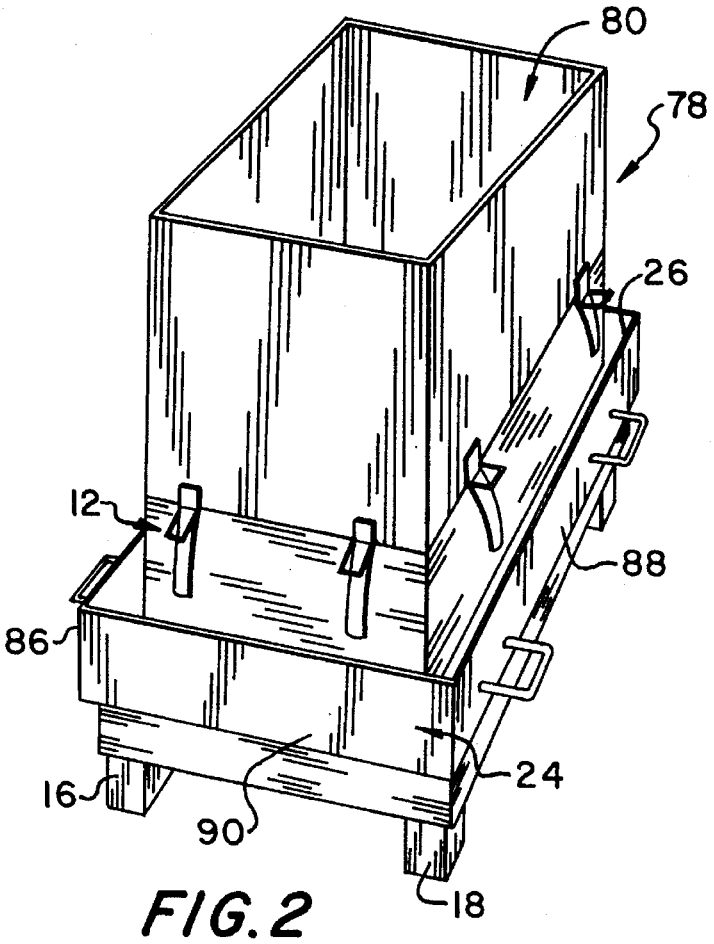
FIG. 2 is a perspective view showing apparatus of the invention provided with a different top member according to a further feature of the invention.

Thus, an important feature of this invention is to furnish cleaning apparatus for the cleaning of chandeliers as disclosed herein in situ wherein top members of a plurality of different sizes and configuration are provided. Thus the invention provides top members that can be readily detached from a base member while maintaining the base member of one size and configuration for various cleaning applications. Such a feature will provide more efficient use of the apparatus of the invention. Accordingly, there is shown in FIG. 2 of the drawing a further embodiment of a top member in accordance with the invention, referred to generally by reference numeral 78. This top member, like top member 42, is defined by open top and bottom ends, the bottom end being detachably connected to the base member 12 of the cleaning apparatus 10, as before-disclosed. As will be appreciated from the drawings, the top and bottom ends of the top member 78 are of equal dimensions. The cavity 80 defined by the parallel side and end walls of the top member communicate with the cavity 40 of the base member, the same as does the cavity provided in top member 42. The depth of the top member, i.e., the distance from the top end to the bottom end thereof, can vary somewhat depending upon the particular application. Thus, and this is of important concern for the most efficient practice of the invention disclosed, the depth only need be such as to allow for full immersion of the lesser length pendants located in the inner rows and columns of pendants in the chandelier.

In general, a chandelier will have only two different length pendants, requiring only two top members of different dimensions and configurations, as above disclosed. Nevertheless, in some cases a chandelier may be provided with more than two lengths of pendants, in which case it may be most desirable to provide top members for accommodating pendants having different lengths, e.g. a 6", a 10", and an 18" pendant Chandeliers provided in different locations in an establishment and in different establishments may even have pendants of different length.

The length of the base and top members, i.e., the distance between opposite end walls can, as will be readily appreciated, varied to some extent. The most optimum length can readily be determined by those in the art. This will depend somewhat upon the material of construction, but largely upon the ability to conveniently handle the apparatus, particularly if done by hand. The more optimum length will also to some extent depend upon the size of the chandelier to be cleaned and the manner of cleaning as later more fully disclosed. The length should, of course, be such as to clean a plurality of pendants at one time, say, for example 24 pendants, located in linear alignment in the same row or column of pendants and spaced-apart next adjacent to one another only about 1–3 inches.

The width of the top member, i.e. the distance between side walls, can also vary to some extent dependant upon the same considerations as the length, as above-mentioned. The width should be such as to accommodate the cleaning of a plurality of next adjacent pendants in the same row or column of pendants. This will depend also upon whether the pendants in the outer row, i.e., the longest pendants, or those in the inner rows, are being cleaned. Thus, the width of top member 42 need be such as to accommodate only those pendants in one row or column. On the other hand, the width of top member 78 should be such as to accommodate a plurality of pendants located in a plurality of partial rows and partial columns of pendants. For example, a top member 78 could be of such length and width as to clean at one time, and in situ, all those pendants located in 24 inner rows next adjacent to one another and in 4 inner columns next adjacent one another. Thus, a rectangular shaped pattern of pendants would be cleaned simultaneously, 24 pendants ×4 pendants, i.e. 96 pendants.

Although the base and top members of the apparatus disclosed herein is shown in the drawings to be of rectangular shape, such need not necessarily be the case. In some cases, a base and top member of square shape may be more desired. Thus, it will be appreciated that, other than in the cleaning of the outer row of pendants, the cleaning apparatus of the invention will operate to clean in situ, and simultaneously, a predetermined plurality of pendants arranged in a rectangular- or square-shaped matrix or array of pendants. When cleaning an outer row of pendants, a plurality of pendants are cleaned simultaneously but all such pendants are located in one row, i.e., the outer row.

It will be appreciated that when a row of pendants is referred to, another could term such a column of pendants, depending on one's orientation. The important thing is that a chandelier may be, for example, of rectangular or square configuration and that when considering a corner pendant such lies both in row 1 and column 1 and that rows extend perpendicularly with respect to columns, the pendants in any one row or column being linearly aligned.

The bottom end 38 of the open-topped base member 12 is provided with a bottom closure 82. This bottom closure provides with the side and end walls of the base member a liquid tight cavity 40. The bottom member and side and end walls can be welded according to conventional techniques to provide such an integral base member. Nevertheless, if desired, the bottom end 38 of the base member can be open, the bottom edges of the base member side and end walls being fixedly attached, instead, to the horizontally disposed planar bottom surface 84 of the overflow jacket 24. This jacket is further defined by vertically upright, spaced-apart, parallel side members 86, 88 which intersect with vertically upright spaced-apart parallel end members 90, 92. As shown in the drawings, the jacket side and end members are spaced apart from the side and end walls of the base member 12 and are provided in parallel disposition therewith. Thus, there is provided the moat or overflow channel 26, earlier mentioned, which surrounds the centrally disposed base member 12 at its bottom end, the purpose for which will be soon made clear. The bottom surface of closure 82 of the base member can be attached to the top surface of the bottom or end member 84 of the overflow jacket 24 by various conventional techniques provided such is fixedly secured and provides against leakage of overflow cleaning liquid into the work area. This can readily be accomplished by welding. Although in the practice of the invention, the base member 12 and overflow jacket 24 were each provided with bottom or end members, this need not necessarily be the case. The bottom member 84 for the overflow jacket 24 can, in some cases, if desired, serve both purposes, as earlier disclosed. One advantage of a dual purpose bottom closure 84 is that the overall cost of the cleaning apparatus can be somewhat reduced, as well as the weight thereof.

Optionally provided on the outside surface of the side member 88 of the Jacket 24 are handles 75, 77, the purpose for which will, it is believed, be obvious. Like handles can be provided in opposed locations on the opposite side member 86. The handles are spaced apart so that the base member 12 of the cleaning apparatus can best be carried and lifted into operative position, as needed, in the most efficient and optimum manner. Handles can be additionally, or instead, provided on the end members, if desired. Or, in some cases, it may be found that such handles located only on the end members will provide more satisfactory handling. The handles provided should take into consideration the overall combined weight of the base member 12, overflow jacket 24, and support platform 14, later described, as such are generally of unitary construction. The weight of the top member should also, of course, be considered, to provide means for handling the entire apparatus, if need be, entirely by hand.

Figure 4:
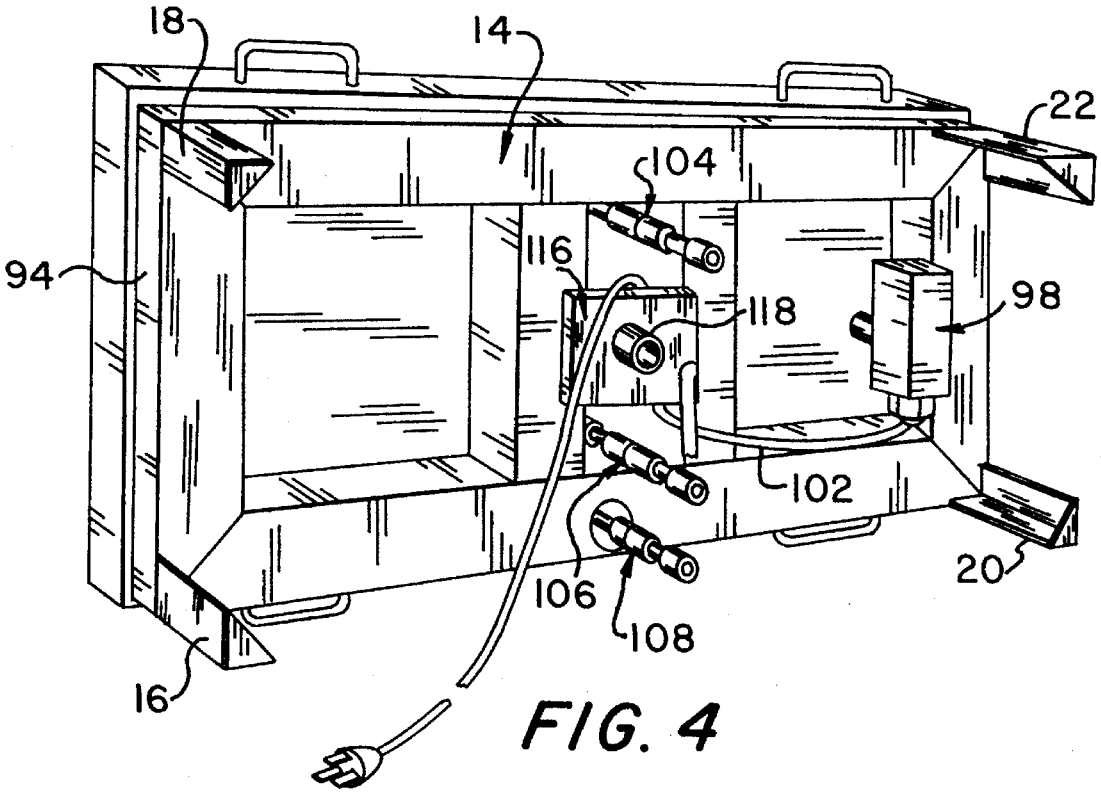
FIG. 4 is a bottom view in perspective showing the bottom of a support member for an ultrasonic cleaning apparatus according to the invention and showing a bearing plate for aid in vertically lifting the apparatus, the location of the junction box for the transducer, and the water inlet and outlet and overflow outlet.

As will be appreciated from the drawings, the base member 12 and surrounding overflow Jacket 24 are fixedly connected to the top horizontally disposed surface 94 of the support platform 14 by conventional means such as spot welding. The support platform 14, as best seen in FIG. 4, is of a skeletal structure. This will allow for good support of the base and top members, as well as the surrounding Jacket 24; however, other configurations will also be found satisfactory, as will be readily appreciated by those in the art. The skeletal structure allows for less cost and weight.

Figure 3:
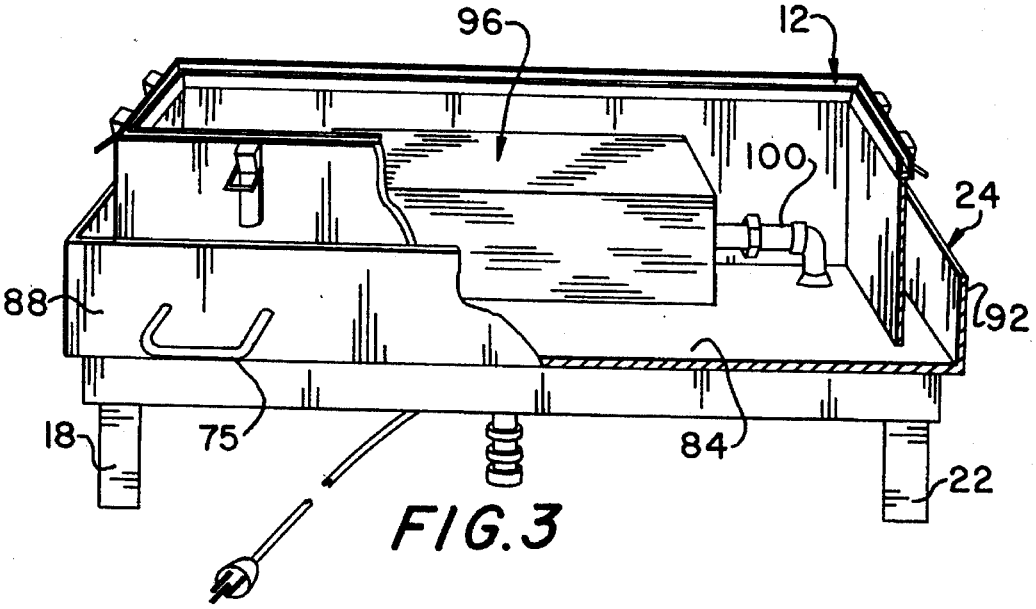
FIG. 3 is a side view in elevation with the top member removed and showing a partial cutaway of the base member, to better illustrate and show the location of the ultrasonic transducer in the base member of the ultrasonic cleaning apparatus.

Turning now to FIG. 3 of the drawing, it will be seen that the ultrasonic cleaning apparatus 10 of the invention further comprises an immersible ultrasonic transducer 96. Various of such transducers that are commercially available may be found suitable for use in the cleaning apparatus of the invention. A major consideration, of course, is that a transducer be selected that is immersible in the cleaning liquid to be used. A further and, of course, critical requirement is that the transducer used in the invention be capable of providing the desired cavitation relative to the amount of cleaning liquid contained in the cleaning apparatus. This will naturally depend, in general, upon the size of the cavities 40, 80 provided in the top and base members. A transducer operating at 40 kHz is preferable for the ultrasonic cleaning of smaller and more delicate components and will be found quite satisfactory for the cleaning of the chandelier pendants disclosed herein.

The ultra-sonic transducer used in the practice of the invention is available commercially from Branson Ultrasonics Corporation, Danbury, Conn. under the trade designation Model AF-618-12. This ultrasonic transducer is, of course, immersible and operates at a frequency of 40 kHz with an output of at least about 360 watts. The transducer used comprises 12 piezoelectric elements comprising lead zirconate titanate ceramic discs in a sandwich-type construction. A rule of thumb provided by the manufacturer is that such a transducer element be provided for each gallon of cleaning liquid contained in the ultrasonic cleaning apparatus. Nevertheless, I have advantageously found that such a transducer performs readily in apparatus according to this invention though such may contain as much as 25–30 gallons cleaning liquid.

Referring to FIG. 4 of the drawing, it will be seen that the junction box 98 provided with the transducer is attached to the bottom of the support platform 14. From the top of the junction box 98 there is provided a conventional conduit 100 which passes through the bottom member 84 into the base member 12, being connected in usual manner at its distal end to the ultrasonic transducer. This conduit houses and provides protection to the power cable connecting the junction box to the transducer elements. The cable 102 is connected at its one end to the junction box 98 and at its other end to an ultrasonic generator (not shown). The generator is provided with a conventional three-prong plug for connection to the usual electrical wall socket or the like.

From the bottom of the support platform 14 there is provided, as seen in FIG. 4, a fill pipe 104 which is connected at its top end (not shown) to base member 12 for the filling of the cleaning cavities provided by the base and top members when, and as desired, with cleaning liquid. The bottom or free end of the fill pipe can be connected by means of a suitable hose or conduit with a source of cleaning liquid. Further, there are provided discharge pipes 106 and 108, respectively, these being fixedly provided respectively in the bottom or end members of the base member and overflow jacket. The drain pipes 106, 108 can be connected to suitable conduits for discharge of any spent cleaning liquid or cleaning liquid that may have overflowed from the top end of the top member into the overflow jacket. The overflow can be discharged either intermittently or continuously, as desired.

It will be appreciated that suitable valves can be provided in the inlet and outlet pipes, as above-disclosed. In some cases, however, it may be more desirable to just provide the free ends of the inlet and outlet pipes with appropriate threads or threaded connectors for attachment to suitable conduits which, in turn, may be connected to a valve at the cleaning liquid source or to waste. These threaded connectors can be, if desired, like those provided on a common garden hose. The connectors can then, as usual, be connected to a suitable length of hose which, in turn, is connected to the discharge valve on a cleaning liquid source and to a discharge source, respectively. Thus, in this case, the cleaning apparatus can, if desired, be filled manually with the cleaning liquid. Conventional end caps may be provided, if desired, on the threaded connectors connected to the outlet and inlet pipes extending from the bottom of the overflow jacket and base member 12.

The optimum configuration of the ultrasonic transducer and its location in the base member will depend to some extent upon the dimensions and configuration of the base member, i.e., whether such is of a rectangular or square shape. For optimum performance, the ultrasonic transducer 96 should be centrally located within the base member. The transducer used in the practice of the invention (Model AF-618-12) as above-mentioned, measures about 6" wide about 18" long, and is about 3 ¼ deep. The base member used in the practice of the invention is of a rectangular shape, about 32" in length, about 12 ½" wide and 7 ½" in height. Thus, with the transducer centrally disposed, as preferred, the sides and ends of the transducer will be surrounded by cleaning liquid. Such is desirable to prevent the transducer from overheating during operation. Further, more uniform cavitation is believed to result from such a location, as the output of the transducer is from the top planar surface thereof. The dimension of the top member above disclosed will depend somewhat upon the length of the particular pendants to be ultrasonically cleaned and the number of pendants desired to be cleaned at any one time. Thus, whether an outer row and column of pendants is to be cleaned, or those located inwardly, will determine whether a top member like that shown in FIG. 1 or FIG. 2 is to be provided. The width and length of such a top member at its top end will be predetermined by the number of rows and columns of pendants to be cleaned simultaneously. Nevertheless, at the bottom end, the top member in the most preferred embodiment is of the same dimensions as the top end of the base member, as earlier disclosed.

The transducer elements (not shown in the drawings) are provided in a linear array extending lengthwise of the base member 12. The transducer 96 because of its linear configuration and location in the base member provides a radiation pattern that is primarily in an upward direction. As a result the ultrasonic waves propagated by the transducer surrounds the elongated pendants from top to bottom providing good overall cleaning of the pendants. The cleaning of the pendants in situ and while the pendants are each disposed during cleaning vertically downwardly and spaced apart from one another precludes little, if any, shadowing from occurring during the ultrasonic cleaning of the pendants. Although the transducer disclosed heretofore, and its centrally disposed location, has been found quite satisfactory in the practice of the invention, it will be appreciated that a transducer with more or fewer elements may be found to provide more optimum cleaning with a base and top member of different size and configuration. Also, a transducer having different elements therein or of a square shape may be found more satisfactory where the base member is a square or the length of the base member is closer to the width dimension. Various transducers for the purposes intended herein are commercially available. The selection of the most optimum transducer for the most optimum size base and top members is believed to be within the skill of those in the art.

The ultrasonic cleaning of a chandelier in accordance with the invention can be done whenever desired, i.e., when such appears to need cleaning or on a set schedule, say every five or six months, to better maintain the attractiveness of the chandelier. In any event, when it is desired to clean a chandelier, the pendants in the outside row, generally the outside row of the outer tier of pendants, are preferably cleaned first. Thus, the ultrasonic cleaning apparatus 10 with the top member 42 attached, as shown in FIG. 1, is first positioned so that the support member 14 is located below the chandelier 10 to be cleaned in a suitable horizontal disposition.

Figure 5:
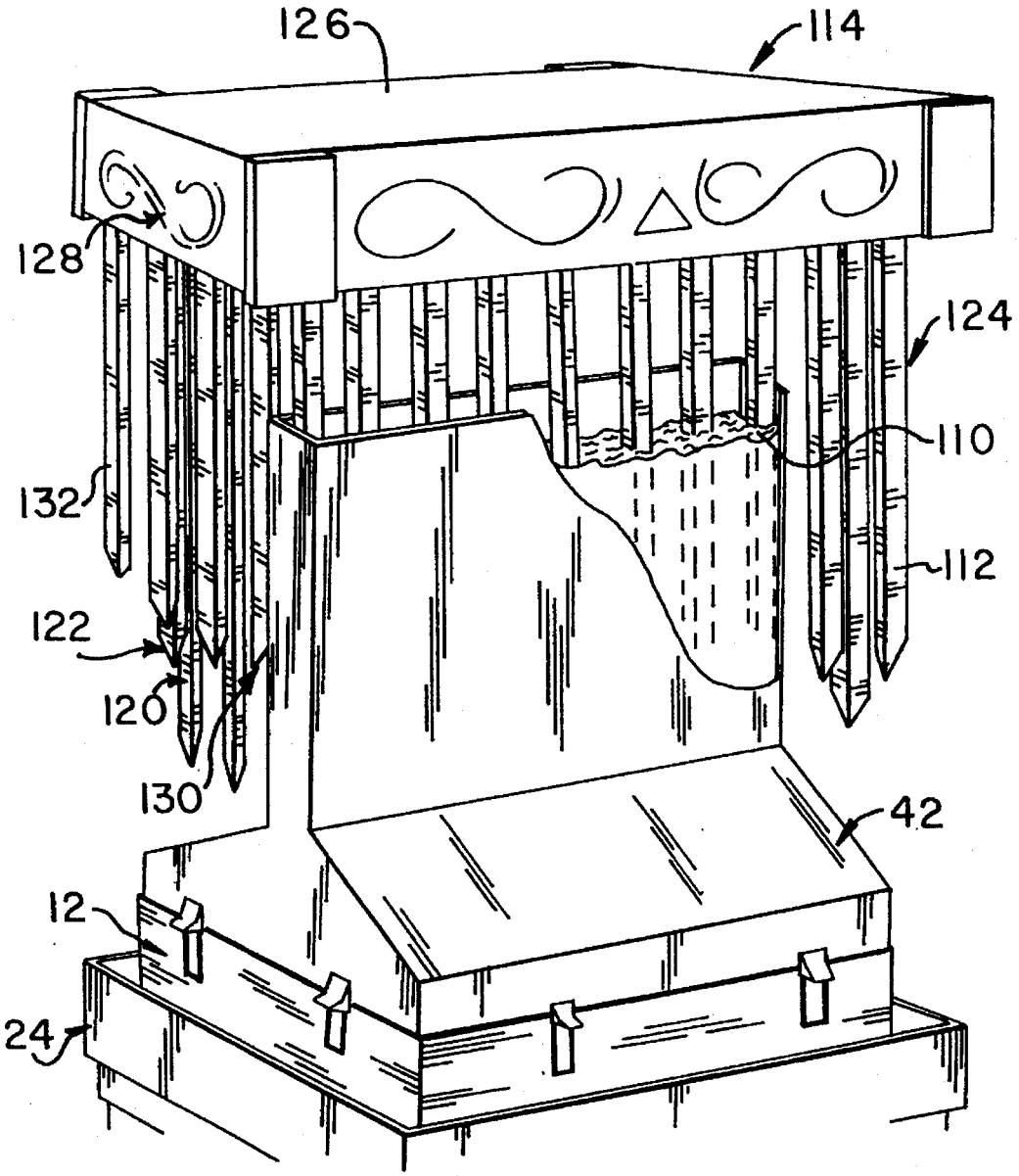
FIG. 5 is a view in perspective showing ultrasonic cleaning apparatus according to the invention in operative combination with a chandelier with the top member intact for the cleaning of the outside row of pendants and with a portion of that top member cut away whereby the cleaning of a first defined number of pendants in the outer row of the downwardly extending pendants is shown.

The distance the cleaning apparatus is located below the chandelier can vary somewhat depending to a large extent upon the means for raising the cleaning apparatus upwardly to its operating position in association with the chandelier, as later more fully disclosed. The main consideration is that the top end of the top member be clear of the bottom ends of the pendants when the cleaning apparatus is first positioned. At this time the cleaning apparatus is supported on a horizontally disposed member of a suitable scaffold or staging having previously been constructed in the desired association with the chandelier. The cleaning apparatus is then more precisely located for association of the open top of the top member (FIG. 1) with the pendants in the outer row. This can be done readily by hand. The cleaning apparatus is then raised to its operative position with the plurality of pendants selected to be cleaned first each being suspended in the cavity of the top member 42, as shown in FIG. 5. Any more precise registration of the top member with the chandelier and the plurality of pendants preselected for cleaning can be made at this time. Desirably the aligned pendants will be located equidistantly from the side walls of the top member. This will better ensure that the downwardly suspended pendants are each subjected to uniform cleaning on the entire surface exposed to the cleaning liquid. The pendants shown in FIG. 5 are not fully immersed in the cleaning liquid 110 for sake of clarity.

The cleaning apparatus 10 should be raised to a sufficient level that the entire length of each of the pendants selected is located within the cavity of the top member. Thus, when the cleaning liquid as later more fully disclosed is added to the cleaning apparatus, the top ends of each of the pendants to be cleaned will be, and this is of critical importance, submerged in the cleaning liquid and below the liquid level about an inch or so. This will ensure that the entire length of the pendants are subjected to the ultrasonic cleaning.

The cleaning apparatus 10 can be raised to its operative position with the chandelier 114, as shown in FIG. 5 of the drawings, and supported in that position by any of various known means for accomplishing such an operation. The method used in the practice of the invention has been to raise the cleaning apparatus to its operative position by means of a conventional portable jack or scissors lift (not shown in the drawings) such as is commonly used in car repair shops and the like. These jacks being provided with wheels, and the cleaning apparatus supported thereby are readily movable from one preselected group or plurality of pendants to be cleaned to another.

To accomplish such raising of the cleaning apparatus, a lift mounting member 116 is provided on the underside of the support platform 14. This mounting is fixedly secured to the support platform and is provided with a circular-shaped collar 118 extending vertically downwardly and perpendicular to the horizontally disposed planar bottom surface of the lift mounting member. The collar 118 is provided with an internal thread pattern the purpose for which will soon be made clear.

The jack or other means for raising the cleaning apparatus to its operative position is provided with a vertically upwardly extending shaft provided at its top end with a thread pattern matching that provided in collar 118. Thus, the cleaning apparatus is coupled to the means for raising it vertically upwardly. The Jack or other raising means can be provided with bracket or support members which are connected at their outer ends to the support platform, e.g. at opposite ends thereof, to maintain the top end of the top member in horizontal disposition to the ceiling of the room or other place supporting the chandelier.

The plurality of pendants at any one time selected to be cleaned will, of course, depend largely upon the size and configuration of the top member and its top opening. The spacing between next adjacent pendants in a chandelier with which this invention is concerned is also of consideration. In fact, the spacing between next adjacent pendants is an important factor in predetermining the length of the top opening. Generally, this spacing is about 1–3". Thus, with such spacing between the pendants, it has been determined that a top opening for the top member 42 of the length earlier disclosed will be found satisfactory for most cleaning Jobs. This length top opening provides relative good efficiency in the cleaning of the chandelier.

It will be appreciated that a larger number of pendants in an outer row can be cleaned simultaneously by making the opening in the top member longer. Nevertheless, this is less preferred as such cleaning apparatus will be less maneuverable and more difficult to handle, particularly when filled with the cleaning liquid. A top member of lesser length than earlier disclosed will simultaneously clean a fewer number of pendants than desired for the most efficient operation.

From a practical standpoint, the optimum number of pendants to be cleaned at any one time largely determines the dimensions for the base member. Then, that design base member, as earlier disclosed, determines the optimum number of pendants that can be cleaned thereafter with such a base member. The optimum dimensions for the base member are determined to some extent by the overall weight to be raised to clean the chandelier pendants in situ.

The chandeliers to be cleaned by the ultrasonic cleaning apparatus of the invention may be of somewhat different size and configuration, and contain more or less pendants. Nevertheless, the pendants will, to a large extent, be arranged in a gridwork comprising a plurality of rows of spaced-apart pendants parallel with one another intersecting with parallel columns of such pendants at right angles. Thus, a pendant will be located in both a row and a column. The rows and columns of pendants in the chandelier may be further arranged in two or more tiers whereby the bottom or lower ends of the pendants terminate in different, parallel, horizontal planes.

Turning now to FIG. 5, it will be seen that the chandelier 114 comprises three tiers of elongated pendants 112, i.e., a center tier 120, a middle tier 122, and an outer tier 124. Although not shown in the drawing for sake of clarity, it will be appreciated that the tiers each comprise a plurality of rows and columns of pendants, the numbers of pendants in each of the rows and columns, generally, being equal in number. The tiers are provided in surrounding relationship, i.e., the outer tier of pendants surrounds the middle tier, and the middle tier of pendants surround the center tier. The pendants 112 are individually suspended (not shown in the drawing) vertically downwardly by their top ends, generally, from the ceiling of the room or other area in which the chandelier is located. Nevertheless, in some cases the top ends of the pendants may be attached, instead, to a horizontally disposed planar backing member 126 which is a part of a decorative framework 128 for the chandelier (FIG. 5), and which itself is attached to the ceiling of the room.

Importantly, however, it will be noted from FIG. 5 that the pendants in the chandelier 114 are not all of the same length. Those located in the outer row of the outer tier are of a much greater length than those located in the inner rows of the outer tier. The pendants located in the inner rows of the outer tier are each of the same length. The pendants located in the rows and columns of the center and middle tiers are generally of about the same length as those of the inner rows of the outer tier, however, these pendants can be of a different length, if desired. Nevertheless, the pendants located inwardly from the outer row can be of a much shorter length, e.g. about 6", because the top ends of such pendants are hidden from view by the pendants in the outer row or a more outer tier. These shorter length pendants are, in general, suspended from the ceiling by their top ends by a flexible chain or the like.

Once the cleaning apparatus is raised to the operative position with the preselected pendants in the outer row, the cleaning apparatus is filled with the cleaning liquid. Quite advantageously, I have found in the practice of the invention, that water without any additives contained therein has worked quite well as the cleaning liquid. Thus, the cleaning liquid used in the cleaning apparatus can readily be discharged to waste without any concern for the environment. Moreover, the use of just water as the cleaning liquid is quite advantageous as such is readily available at the establishment where the chandelier is located. None of the agents, e.g., ammonia, trisodium phosphate, and the like agents commonly used in the cleaning of glass need to be added to the water. The cleanliness of the pendants first cleaned can readily be determined by visual observation. If the first selected cleaning time is insufficient for the desired cleaning of the pendants, the ultrasonic transducer can be operated for a longer cleaning time. Thus, the initial pendants cleaned will serve as a means of adjusting the best cleaning time for the remaining pendants to be cleaned.

Following, the filling of the cleaning apparatus with the cleaning liquid, the ultrasonic cleaning apparatus is then energized to effect the cleaning of the pendants then located in the cavity of the top member. These pendants are readily cleaned by the ultrasonic cleaning apparatus disclosed in a matter of about 1–5, generally about 2–3, minutes, depending upon how dirty the pendants may be. Preferably, however, at least in some cases, prior to the turning on of the ultrasonic transducer, the incoming water for filling the cleaning apparatus is allowed to overflow the top end of the top member. This overflow will, of course, be captured in the overflow jacket 24 of the apparatus. Thus, the selected pendants are given, in a sense, a precleaning with the cleaning liquid, prior to being subjected to ultrasonic cleaning. Any loose particles of dust, dirt, etc. will be carried off in the overflow cleaning liquid. This will leave a somewhat cleaner bath of cleaning liquid when the ultrasonic cleaning is initiated.

Following the cleaning of the first selected number of pendants, the cleaning apparatus 10 is lowered so that the bottom ends of the pendants are clear of the top end of the top member. Thus, the cleaning liquid will be allowed to drain off the pendants just cleaned. The used cleaning liquid will then, in some cases, be drained from the cleaning apparatus. Nevertheless, this is generally not the case. The cleaning apparatus is then repositioned as before so that the opening in the top member is lined up with the next group of pendants to be cleaned. This next preselected plurality of pendants will be those located in serial fashion from the first selected group or plurality of pendants just having been subjected to the ultrasonic cleaning. The selected pendants can either be those in a row or column of pendants so long as such are located outermost in the chandelier. This selection will depend to some extent on the number of pendants being located in a particular row or column, to provide the greater efficiency in the use of the apparatus.

The cleaning apparatus is then again raised as before, the cleaning apparatus is again filled with the cleaning liquid, if drained out, allowing for overflow, to submerse the selected pendants below the liquid level, and the ultrasonic transducer energized. If the cleaning apparatus is not filled with fresh water, sufficient fresh water may be introduced to provide overflow for the purpose earlier disclosed. This group of pendants is then cleaned by the ultrasonic cavitations produced. This procedure continues until all of the pendants in the outer row of the chandelier have been cleaned.

After the pendants in the outer row have all been cleaned, the top member 42 is replaced with a top member such as shown in FIG. 2. The cleaning apparatus is then positioned so that a preselected number of the pendants located in the inner rows and columns can then be cleaned. Thus, the pendants preselected will be those located in the columns and rows next adjacent to the outer row of pendants and to one another. Accordingly, if a chandelier comprises in the outer tier 15 rows and 10 columns of pendants and is capable of cleaning a plurality of pendants arranged in 5 rows and 4 columns of pendants, the next pendants to be selected for cleaning will be those located in rows 2–6 and columns 2–5. This assumes that the pendant designated by reference numeral 130 in FIG. 5 lies in row 1, column 1 of the pendants comprising the chandelier 114, and that designated by reference numeral 132 lies in row 1, column 10. The cleaning apparatus is filled with cleaning liquid, such being allowed to overflow for a predetermined amount of time, e.g. about 1 minute, and the ultrasonic transducer is energized for the previously predetermined time period. The cleaning apparatus is lowered as before, the cleaning liquid allowed to drain off the pendants just cleaned and the spent cleaning liquid and overflow, if desired, discharged to waste.

The cleaning apparatus is again repositioned below the next preselected plurality of pendants to be cleaned. Thus, the cleaning apparatus is positioned below those pendants located in rows 7–11 and columns 2–5. These pendants are then cleaned as before described. The next group of pendants is then selected for cleaning until all the pendants in columns 2–5 of the chandelier have been cleaned. Following that the pendants that are located in rows 2–6 and columns 6–9 are cleaned. This manner of selection and cleaning continues until all of the pendants in the chandelier have been cleaned as disclosed herein.

It will be appreciated that, instead of first cleaning those pendants located in rows 2–6 and columns 2–5, the cleaning apparatus can be differently oriented with respect to the rectangular array of pendants. Thus, the cleaning apparatus can be so oriented that the first group of inwardly located pendants to be cleaned are those located in rows 2–5 and columns 2–6, if desired. The next selected pendants for cleaning in this case will be those located in rows 2–5 and columns 7–11 until all the pendants located in rows 2–5 have been cleaned. The cleaning apparatus is then positioned to clean the pendants located in rows 6–9 and columns 2–6, etc., as earlier described in serial fashion, until all the pendants in the chandelier have been cleaned.

The last group of pendants in the chandelier to be cleaned may contain a fewer number of pendants than the earlier predetermined numbers to be selected. This will depend upon the number of pendants in the chandeliers, the number of rows and columns, the size opening of the top members, etc. It will be appreciated that where a chandelier is encountered of a standard size, the size of the top openings of the top members can readily be determined for the most efficient cleaning operation. In some cases, it may be most desirable that the top member such as shown in FIG. 2 be of a square configuration, rather than rectangular. This will be particularly the case where the inner rows and columns are of a like number. In this case the top opening of the top member for cleaning of the outer row of pendants can be designed such that each time the same number of pendants are cleaned.

Figure 6:
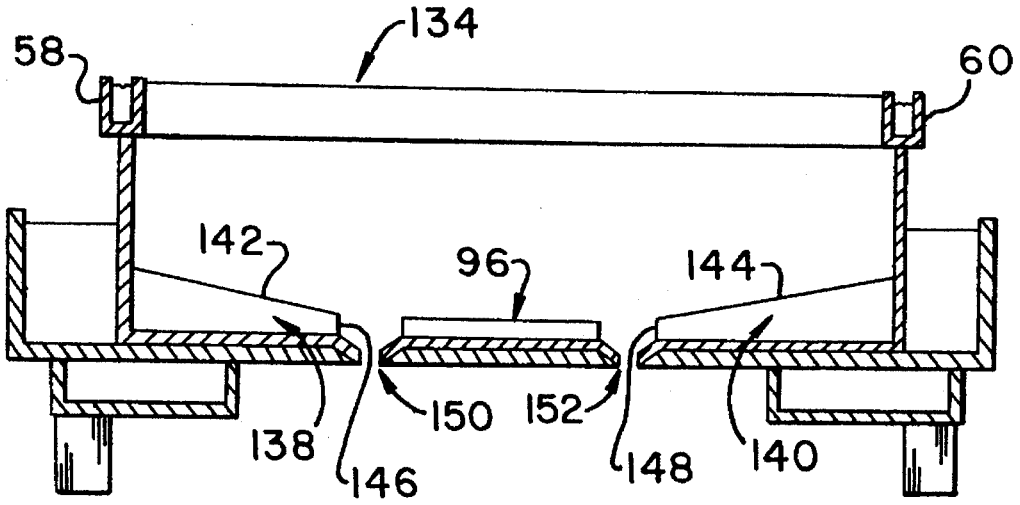
FIG. 6 is a view in cross-section showing the inwardly sloping floor members of the base member according to a more preferred embodiment of the invention.

Turning now to FIG. 6 of the drawing, there is shown therein a further embodiment of a base member 134, in accordance with the invention. The bottom closure 136 for the base member provides support for the floor members 138, 140, the purpose for which will soon be disclosed. The floor members are provided with top planar surfaces 142, 144 which incline downwardly toward the bottom closure and inwardly into the cavity of the base member. The inclined surfaces extend lengthwise of the base member and are fixedly connected to the end walls and side walls, providing a water tight cavity.

The inclined surfaces 142, 144 terminate respectively in vertically disposed end walls 146, 148, the end walls being fixedly connected at their top ends to respective inclined surfaces and at their bottom ends to the bottom closure. The top ends of the end walls lie in the same horizontal plane as the top planar surface of the transducer. Thus, as will be appreciated, the end walls are spaced-apart from the sides of the transducer and the ends of the transducer are spaced-apart from the end walls of the base member, such as is shown in FIG. 3. This allows cleaning liquid to completely surround the transducer and provides not only for a somewhat lower operating temperature but sound deadening as well.

The angle of incline of the inclined surfaces 142, 144 can vary somewhat, as desired, depending upon the overall dimensions of the base member. An angle from the horizontal of from about 5–15, preferably about 10, degrees will be found quite satisfactory. The greater the angle of incline, the less the volume of the cavity in the base member for containment of cleaning liquid. Such inclined surfaces are preferred in the base member, particularly where not only water consumption but weight is of concern.

The bottom closure for the base member, as earlier disclosed, is provided with openings for connection of the inlet and discharge conduits. These openings 150, 152 can be provided so that such incline downwardly, as shown in FIG. 6. This will allow for better discharge of cleaning liquid from the cleaning apparatus. Providing that both openings are inclined allows either to be used as the discharge connection, if desirable. Although not specifically shown in the drawings, a channel extending from each end wall of the base member, as earlier disclosed, and being inclined downwardly toward the center of the closure member can be provided, to allow for even better discharge. Such channels terminate at downwardly extending outlets, providing a good rate of discharge of cleaning fluid.

It will be readily recognized by those in the art that the dimensions of the ultrasonic transducer and the number of elements and size thereof can be altered so that a proper relationship between the area of surface to be cleaned and the surface area of the cleaning apparatus, i.e., the transducer top surface, are arrived at. In addition, variable control functions to regulate the operation of the cleaning apparatus can be added to the inventions, e.g., an on/off switch, a timer for the overflow, automatic operation of the filling of the cleaning apparatus, timer for the ultrasonic transducer energization, etc. It is possible in some cases that different rows of the pendants or sections of rows may require different cleaning times. This may depend upon the location of the chandelier, the environment, etc. Different cleaning rates may be needed for chandeliers located at different establishments, e.g., motels, or even sometimes for chandeliers in different locations at the same establishment. Once a predictable pattern can be established, a microprocessor control can be programmed to give different chandeliers or different areas of the same chandelier different lengths of cleaning time or the entire chandelier different cleaning rates.

The cleaning apparatus of this invention has been specifically disclosed with respect to chandeliers wherein the pendants are arranged in parallel rows and columns of pendants. Nevertheless, apparatus such as disclosed herein can also be used to clean chandeliers wherein the pendants are provided in a plurality of concentric circles. In this case, a top member such as disclosed in FIG. 2 is used. Nevertheless, it will be appreciated that cleaning apparatus having at least curved top members of the desired curvature can be designed specifically for this application. The top member can be designed so that its side members are of the same concentricity as the circular rows of pendants in the chandelier. The ends of the top member opening will be located on radii of the concentric circles of pendants. In some cases, the chandeliers having pendants in concentric circular patterns also have pendants in the outer row festooned. Where such a chandelier is encountered, one only need disconnect the swag or festoon at one end, allowing the pendants, e.g. spaced apart crystal beads connected together in serial fashion, to hang vertically downwardly.

It will be understood that various changes in the details, materials, arrangement of parts, and operational conditions which have been herein described and illustrated in order to explain the nature of the invention and its operation may be made by those skilled in the art within the principals and scope of the invention.

Having thus set forth the nature of the invention, what is claimed is:

1. A method for the cleaning of a chandelier comprising a plurality of elongated pendants each being defined by a top end and a bottom end, the pendants each being suspended by the top end vertically downwardly from a horizontally disposed member and being located in predetermined spaced-apart locations in a pattern of parallel rows and columns of pendants comprising the following steps:

(a) preselecting a said chandelier for cleaning comprising a predetermined number of vertically disposed, elongated pendants, each of said pendants being defined by a top end and a bottom end and being located in predetermined spaced-apart locations from a next adjacent pendant, the pendants each being suspended by the top end thereof from a horizontally disposed member located in an area in which the chandelier is located;

(b) preselecting from said predetermined number of pendants a predetermined lesser number of next adjacent pendants for cleaning;

(c) providing ultrasonic cleaning apparatus for the cleaning of the predetermined number of pendants of the chandelier, a cavity being provided in the ultrasonic cleaning apparatus for the holding of cleaning liquid;

(d) positioning the ultrasonic cleaning apparatus below the predetermined lesser number of pendants selected;

(e) providing cleaning liquid in the cavity of the ultrasonic cleaning apparatus; (f) raising the ultrasonic cleaning apparatus upwardly a distance whereby to immerse the top ends of each of the predetermined lesser number of pendants in the cleaning liquid;

(g) causing the preselected lesser number of pendants immersed in the cleaning liquid to be cleaned in situ by ultrasonic cleaning;

(h) preselecting a second lesser predetermined number of pendants from said predetermined number of pendants for cleaning;

(i) causing the second lesser predetermined number of pendants selected to be cleaned by ultrasonic energy; and (j) repeating steps (b)–(i) until all of the predetermined number of pendants have been ultrasonically cleaned.

2. A method for the cleaning of a chandelier in situ comprising a plurality of elongated pendants each being defined by a top end and a bottom end, the pendants each being suspended by the top end vertically downwardly from the ceiling of an area in which the chandelier is located, said pendants each being located in predetermined spaced-apart locations from next adjacent pendants comprising:

(a) preselecting a said chandelier for cleaning wherein the plurality of pendants comprises a predetermined number of pendants, said pendants being arranged in a plurality of parallel rows and columns of pendants, the pendants in each row being of a like number and being linearly aligned with respect to other pendants in a row of pendants and the pendants in each column being of a like number and linearly aligned;

(b) preselecting for cleaning from said plurality of parallel rows of pendants at least one row comprising a plurality of next adjacent pendants;

(c) preselecting for cleaning from said at least one row of pendants a predetermined number of next adjacent pendants;

(d) providing ultrasonic cleaning apparatus for the cleaning of said predetermined number of pendants of the chandelier, a cavity being provided in the ultrasonic cleaning apparatus for the holding of cleaning liquid;

(e) positioning of said ultrasonic cleaning apparatus below the predetermined number of pendants selected;

(f) raising said ultrasonic cleaning apparatus so that the predetermined number of pendants selected in the said at least one row of pendants is in operative association with the ultrasonic cleaning apparatus;

(g) filling of the ultrasonic cleaning apparatus with water so that the top ends of said predetermined number of pendants are submersed in the water;

(h) causing the predetermined number of pendants selected to be cleaned by said ultrasonic cleaning apparatus;

(i) preselecting for cleaning a second predetermined number of pendants from said at least one row of pendants;

(j) positioning of the ultrasonic cleaning apparatus so that the second predetermined number of pendants are in operative association with the ultrasonic cleaning apparatus and the top ends of the selected pendants are immersed in the water provided in the cleaning apparatus;

(k) causing the second predetermined number of pendants to be cleaned by the ultrasonic cleaning apparatus; and (i) repeating steps (b)–(k) until all of the predetermined number of pendants of the chandelier have been cleaned.

3. A method according to claim 1 wherein prior to causing each of the successive predetermined number of pendants to be cleaned ultrasonically the ultrasonic cleaning apparatus is filled with fresh water.

4. A method according to claim 1 wherein prior to causing each of the successive predetermined number of pendants to be cleaned ultrasonically the water is caused to overflow the cleaning apparatus whereby loose foreign bodies on the pendants are washed off and carried out in the overflow water.

5. In a method for the cleaning of a chandelier comprising a plurality of elongated pendants each being defined by a top end and a bottom end, the pendants each being suspended by the top end vertically downwardly from the ceiling of an area in which the chandelier is located and being located in predetermined spaced-apart locations from next adjacent pendants, the pendants being provided in a plurality of parallel rows and columns of pendants defining a chandelier having a rectangular shape and defining an inner tier of pendants, a middle tier of pendants and an outer tier of pendants the bottom ends of the pendants in each tier of the pendants defining a horizontally disposed plane parallel to that of the other tiers, the improvement comprising:

(a) providing ultrasonic cleaning apparatus having a top member defined by open top and bottom ends and a base member defined by an open top member detachably connected to the top member, a cavity being provided in said top member and said base member and being in communication with one another, said cavities each being defined by vertically disposed side and end walls;

(b) positioning the ultrasonic cleaning apparatus so that the top member is located directly below the chandelier;

(c) preselecting a lesser plurality of the pendants to be cleaned from the predetermined plurality of pendants comprising the chandelier;

(d) raising the ultrasonic cleaning apparatus vertically upwardly so that the bottom ends of the pendants each intrude into the open top end of the top member and are located at least in the cavity provided in the top member;

(e) filling the cavities provided in the top and base member of the ultrasonic cleaning apparatus with a sufficient amount of water to immerse the top ends of the pendants in the water;

(f) energizing the ultrasonic cleaning apparatus to provide sufficient cavitation in the water to clean the preselected lesser plurality of pendants to be cleaned ultrasonically and simultaneously in situ;

(g) lowering of the ultrasonic cleaning apparatus so that the bottom ends of the preselected pendants are free from the water;

(h) preselecting a second lesser plurality of pendants from the plurality of pendants in situ remaining to be cleaned;

(i) raising the ultrasonic cleaning apparatus so that the top ends of the second preselected lesser plurality of pendants are submersed in the water;

(j) causing the second preselected lesser plurality of pendants to be cleaned by the ultrasonic cleaning apparatus;

(k) lowering of the ultrasonic cleaning apparatus so that the bottom ends of said second lesser plurality of pendants clear the water; and (l) repeating steps (h)–(k) until all of the plurality of pendants comprising the chandelier have been ultrasonically cleaned.

6. In a method according to claim 5 wherein after each lowering of the cleaning apparatus, the cleaning apparatus is filled with fresh water.

7. In a method according to claim 5 wherein during the filling of the ultrasonic cleaning apparatus with water, the water first contacting the pendants to be cleaned and flowing over the pendants from the bottom ends thereof to the top ends thereof is allowed to overflow the top end of the cleaning apparatus whereby loose foreign particles located on the surface of the pendants will be carried away with the overflow.

8. In a method according to claim 5 wherein the pendants to be cleaned are located in next adjacent inner rows and columns of pendants and a predetermined plurality of pendants is selected determined by the number of rows and columns selected.

9. In a method according to claim 5 wherein the outer tier of pendants is defined by an outer row of pendants and at least one inner row of pendants parallel to the outer row and the outer row of pendants is first cleaned.

10. In a method according to claim 9 wherein the pendants in the outer row of pendants are of a greater length than those in the inner rows.

11. A method for the cleaning in situ of a plurality of elongated pendants of a chandelier each being defined by a top end and a bottom end, the pendants each being attached to the ceiling of a room at their top ends and extending vertically downwardly comprising:

(a) providing ultrasonic cleaning apparatus defined by an internal cavity for the containment of cleaning liquid;

(b) placing the ultrasonic cleaning apparatus below said chandelier;

(c) elevating the ultrasonic cleaning apparatus so that the bottom ends of a predetermined selection of the downwardly extending pendants extend into the cavity of the cleaning apparatus;

(d) filling the internal cavity of the ultrasonic cleaning apparatus with cleaning liquid to a level that the top ends of the elongated pendants are submerged below the top of the cleaning liquid;

(e) impressing ultrasonic energy into the cleaning liquid with at least one ultrasonic energy producing means at an energy sufficient to produce cavitation in the cleaning liquid; and (f) maintaining the ultrasonic energy for a sufficient period of time to effect the desired cleaning of the pendants immersed in the cleaning liquid.

12. A method for the cleaning of a chandelier comprising a plurality of elongated pendants each being defined by a top end and a bottom end, the pendants each being suspended by the top end vertically downwardly from a horizontally disposed member and being provided in a plurality of concentric circles comprising the following steps:

(a) selecting a chandelier for cleaning comprising a predetermined number of vertically disposed, elongated pendants, said pendants being provided in a plurality of concentric circles, each of said pendants in each of said plurality of concentric circles being defined by a top end and a bottom end and being located in predetermined spaced-apart locations from a next adjacent pendant, the pendants each being suspended by the top end thereof from a horizontally disposed member located in an area in which the chandelier is located;

(b) providing ultrasonic cleaning apparatus defined by an open top end, a cavity being provided in the ultrasonic cleaning apparatus and cleaning liquid being provided in said cavity;

(c) immersing said predetermined number of pendants in said cleaning liquid, said cleaning liquid covering the top end of each of the pendants; and (d) causing the predetermined number of pendants to be cleaned in situ by said ultrasonic cleaning apparatus.

13. A method according to claim 12 wherein the open top end of the ultrasonic cleaning apparatus is defined by an arc of a circle concentric to the plurality of concentric circles of elongated pendants.

* * * * *